US005571055A

United States Patent [19]

Lewis et al.

[11] Patent Number: 5,571,055

[45] Date of Patent: Nov. 5, 1996

[54] GOLF TEE STAND WITH GROUND ANCHORING MECHANISM AND NON-ADJUSTABLE BASE

[76] Inventors: Timothy J. Lewis, 528 Kahkwa Blvd., Erie, Pa. 16505; David W. Lewis, Jr., R.D. 1, Center Rd., Box 202, Venango, Pa. 16440

[21] Appl. No.: 403,293

[22] Filed: Mar. 14, 1995

[51] Int. Cl.[6] ..... A63B 57/00

[52] U.S. Cl. ..... 473/398; 473/402

[58] Field of Search ..... 273/33, 202–212; 411/481, 482, 451, 456, 487, 923

[56] References Cited

U.S. PATENT DOCUMENTS

| | | | |
|---|---|---|---|
| 1,550,483 | 8/1925 | Wulkop | 273/208 |
| 1,623,782 | 4/1927 | Dent et al. | 273/33 |
| 1,625,911 | 4/1927 | Richards | 273/202 |
| 1,679,579 | 8/1928 | Lundy | 273/33 |
| 1,705,371 | 3/1929 | Mehlman | 411/923 |
| 2,317,231 | 4/1943 | Swedman | 411/456 |
| 3,114,557 | 10/1960 | Cabot | 273/202 |
| 3,203,700 | 8/1965 | Antonious | 273/202 |
| 3,406,978 | 10/1968 | Johnson, Jr. | 273/207 |
| 3,408,079 | 10/1968 | Kirikos | 273/202 |
| 3,467,390 | 9/1969 | Gardiner | 273/183 |
| 3,606,344 | 9/1971 | Ball | 273/202 |
| 3,690,676 | 9/1972 | Costa | 273/202 |
| 3,883,144 | 5/1975 | Lazow | 273/183 |
| 4,516,780 | 5/1985 | Tabet | 273/202 |
| 5,052,689 | 10/1991 | Lettrich | 273/183 |
| 5,058,315 | 10/1991 | Wagner | 411/456 |
| 5,221,099 | 6/1993 | Jänsch | 279/151 |
| 5,242,161 | 9/1993 | Wilkirson | 273/32.5 |

FOREIGN PATENT DOCUMENTS

| | | | |
|---|---|---|---|
| 219242 | 12/1958 | Australia | 273/203 |
| 941337 | 11/1963 | United Kingdom | 273/203 |

*Primary Examiner*—Steven Wong

[57] ABSTRACT

Presented is a golf tee device having ground anchoring prongs to stabilize the tee upon impact with a club head and keep the tee from "popping" out of the ground and traveling haphazardly. Also, the tee incorporates a circular non-adjustable base feature that limits the depth to which the tee can be inserted into the ground, thereby adjusting the elevation of the golf tee, and thus providing a platform for the golf ball that is the proper elevation to meet the needs of a particular golfer. Further, the base feature also aligns the tee in a perpendicular position relative to the ground. Incorporation of spine supporting radii above and below the base feature serve to significantly increase the strength and resiliency of the device.

1 Claim, 1 Drawing Sheet

GOLF TEE STAND WITH GROUND ANCHORING MECHANISM AND NON-ADJUSTABLE BASE

BACKGROUND—FIELD OF INVENTION

The present invention relates to a new and improved golf tee device, specifically to new and improved features that anchor the tee in the ground upon impact, support a golf ball perpendicular to and at a predetermined height above the ground, and add significant strength and stability to the tee.

BACKGROUND—DISCUSSION OF PRIOR ART

Under the official United States Golf Association (USGA) rules of golf, when teeing, the ball may be placed on the ground, on an irregularity of surface created by the player on the ground, or on a tee, sand, or other substance in order to raise it off the ground. Originally, golf tees were very simple structures, designed only to raise the golf ball off of the ground before striking the ball from the teeing area. However, conventional tees do little to effectively help eliminate or control three other variables that can adversely affect a golfer's skill and enjoyment level.

These include:

1. the height of the ball above the teeing ground in relation to a golfer's particular swing and his/her chosen club. If a ball is teed too low, golfer's of all skill levels have a tendency to hit the ball "fat" or "top" the ball. In either case, the result is typically a short drive. Conversely, If a ball is teed too high, players have a tendency to "sky" the ball. This also results in a drive that travels a very short horizontal distance.

2. the proper position or alignment of the tee to ensure it is inserted perpendicular (at a 90 degree angle) to the ground. Proper positioning of the tee in relationship to the ground helps the ball fly straighter upon contact with a club.

3. the stability of the golf tee upon impact with a club. Conventional tees do one of two things upon impact. They either fracture along the spine, or "pop" out of the ground and travel haphazardly to be lost or so far out of line that the golfer does not attempt to recover the tee.

A preliminary patentability and novelty search in connection with this invention has revealed the issuance of a number of patents that attempted to resolve some of the above mentioned problems. U.S. Pat. No. 3,114,557 discloses a golf tee, the shank of which is provided with longitudinally extending lugs. An annual collar is provided with notches extending radially outward from the central boar. The collar can be adapted to be aligned with the lugs so as to permit the collar to be raised or lowered, at the discretion of the golfer, then turned to lock in position. The disadvantages of this device relate to the adjustable mechanical parts, which can be time consuming to adjust, especially given the buildup of dirt that forms around the lugs when the tee is inserted into the ground. This significantly increases the difficulty of raising or lowering the column. Also, since the device contains multiple components, it is difficult to use and expensive to manufacture.

U.S. Pat. No. 3,203,700 provides a golf tee, the spine of which is provided with several pairs of carved out notches. A metal clip is provided that can be engaged with the notches at whatever height is desirable or the golfer. Establishing the desired height of the tee above the ground is achieved by inserting the clip in a selected pair of notches on the spine. One of the disadvantages of this device again relates to the adjustable mechanical parts, which can be time consuming to adjust, especially given the buildup of dirt that forms in the notches of the tee when it is inserted into the ground. This significantly increases the difficulty of raising or lowering the metal clip. Also, the notches on the spine serve to weaken the tee's strength and make it more likely to break upon impact of the club head. This device also contains multiple components and is therefore more complicated to use and expensive to manufacture.

U.S. Pat. No. 3,408,079 relates a golf tee having a vertically adjustable ground engaging stop member having a square hole adapted to slide and engage designated square spine "cut out" portions of the tee. To position the height adjusting member, corner portions of the spine are removed, permitting the annular plate to be adjusted vertically and then rotated to lock in place along the spine. This device shams some of the disadvantages related to the above mentioned patents. The adjustable mechanical parts can be time consuming to adjust, especially given the buildup of dirt that forms in the cut-out portions of the tee when it is inserted into the ground. This significantly increases the difficulty of raising or lowering the ground engaging stop member. Also, the "cut-outs" on the spine serve to weaken the tee's strength and make it more likely to break upon impact of the club head. This device also contains multiple components and is therefore more complicated to use and expensive to manufacture.

U.S. Pat. No. 4,516,780 provides a golf tee formed of two coaxially arranged members. The upper and ball supporting member is engaged by sliding it into a longitudinal bore formed in the lower member, with the interengaging surfaces of the inner and outer member being such as to permit the upper member to be frictionally held in whatever position the golfer selects. The outer member having the golf ball supporting head is provided with a cross pin that penetrates a slot formed in the adjustable portion. This permits axial adjustment of one part in relation to the other while also preventing complete separation of the two parts. While this device allows a golfer to adjust and customize the elevation of the ball, it is extremely cumbersome, and time consuming to use. It also contains multiple components and is therefore more complicated to use and expensive to manufacture.

U.S. Pat. No. 3,690,676 provides a golf ball tee consisting of a base structure of a conical shape with a substantially wide base that acts to retard the flight of the device when subject by the impact of the club head. The skirt portion has a lip that is adapted to snap into grooves formed on the adjustable tubular upright that is supported thereon and which functions to seat the golf ball. While this instrument also allows a golfer to adjust and customize the elevation of the ball, it is again cumbersome, time consuming, and complicated to use. It contains multiple components, is expensive to manufacture, and is inherently designed to take flight from the tee box upon impact of the club head.

U.S. Pat. No. 5,052,689 provides a support structure used in conjunction with a conventional tee to support a golf ball at a selected height above the ground. The device comprises a cylindrical tube, into which a conventional tee is inserted. The bottom portion of the tube forms a ground engaging member that helps control the tee height above the ground. The cylindrical tube also has a means for frictionally engaging the shank of a conventional tee. The tube itself has a means for adjusting its length, thus allowing the device to be used without a conventional tee if desired. While this device allows a golfer to adjust the elevation of the ball, a unique adjustment has to be made by the golfer that is heavily reliant on the type and size of the conventional tee used. This does not guarantee the golfer of obtaining a consistent height each and every time. While the device mentioned in the above patent can be used without a conventional tee, its inherent design will cause it to take flight from the tee box upon impact of the club head.

U.S. Pat. No. 3,883,144 provides a golf tee structure with a support consisting of a pair of flat, bar-like elongated members in coplanar, intersecting relation to each other. The spine portion of the tee passes through the intersecting members at their junction, whereby the intersecting members extend outward from the spine at right angles to one another. The members serve to control the height of the ball above the ground and provide a visual guide for the golfer so that he/she may properly position their feet. While this device does allow a golfer the ability to control the elevation of the ball, the bar-like elongated members make it extremely cumbersome to carry and serve to weaken the spine of the tee. Also, it contains no ground anchoring device and is thus likely to take flight from the tee box upon impact of the club head.

Other golf tees are known which include a means for limiting the extent of insertion of the tee into the ground, thereby locating the ball at a preselected height above the ground. However, such known tees are of a complicated construction, are expensive to manufacture, are designed to break or take flight upon impact of the club head, and are of such restrictive function that their use is substantially limited by golfers.

OBJECTS AND ADVANTAGES

Accordingly, several objects and advantages of the invention described herein include:

1. to provide a new and improved golf tee that stabilizes itself upon impact with a club, thus keeping the tee from "popping" out of the ground and traveling haphazardly.

2. to provide an improved golf tee that allows golfers to obtain a consistent tee height each and every time the ball is teed up.

3. to provide a golf tee that fully aligns the tee, and therefore, the golf ball, in a position that is truly perpendicular to the ground.

4. to provide a golf tee with improved strength and resiliency.

5. to provide a golf tee that helps increase the speed of play.

6. to provide a new and improved golf tee that retains a strong resemblance to conventional golf tee devices that have come to be accepted by the majority of golfers.

7. to provide a single member golf tee with a non-adjustable base feature that can be manufactured at any point along the spine of the tee, thus allowing for production of multiple variations of the tee, each having a specific distance between the base feature and ball supporting structure of the tee.

8. to provide multiple variations of a single member golf tee that can be color coded for easy identification.

9. to provide a golf tee with a non-adjustable base feature that allows a very visible and broad surface area for personalization or advertising purposes.

10. to provide a golf tee device that conforms to the USGA rules of golf, thus enabling the tee to be utilized by players of all skill levels, amateurs and professionals alike.

11. to provide a golf tee that is simple in configuration, economical to manufacture, convenient to carry and insert into the ground, and serves to substantially control factors that will enhance a golfer's skill and enjoyment level.

Further objects and advantages of the invention will become apparent from a consideration of the drawings and ensuing description.

DRAWING FIGURES

REFERENCE NUMERALS IN DRAWINGS

Figure 1:
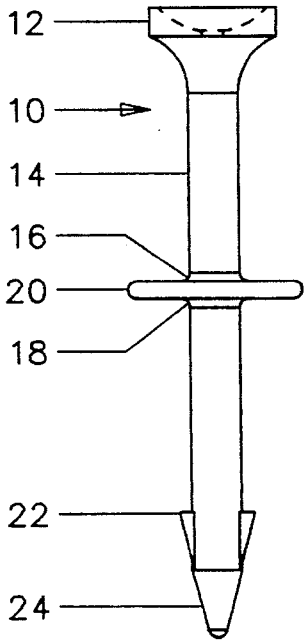
FIG. 1 is a side elevational view showing the golf tee device embodying the principles of this invention.

10 golf tee
12 head
14 spine
16 upper spine support radius
18 lower spine support radius
20 base feature
22 ground anchoring prongs
24 pointed tip

Figure 2:
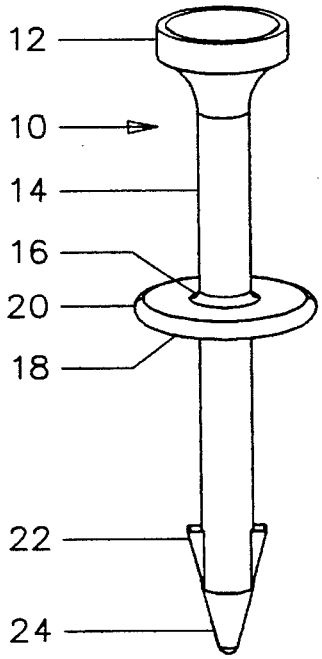
FIG. 2 is an perspective view thereof.
Figure 3:
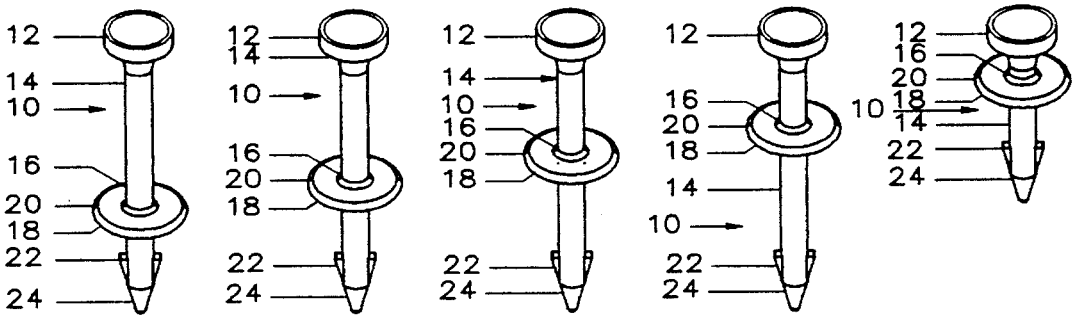
FIG. 3 is an perspective view showing a number of variations of the golf tee device with the non-adjustable base feature manufactured at various points along the spine of the tee.

DESCRIPTION—FIGS. 1 to 3.

A typical embodiment of the golf tee of the present invention is shown in FIG. 1 (side elevational view) and FIG. 2 (perspective view). The golf tee of this invention is a single member formed of suitable material such as molded plastic resin. The tee includes numerous structural features designed to effectively minimize and control a number of variables that can adversely affect a golfer's skill and enjoyment level. The tee provides a means for obtaining a truly consistent tee height, with respect to the ground into which the tee is inserted, each and every time the ball is teed up. Further, the tee provides a means for obtaining the proper position or alignment of the tee to ensure it is inserted perpendicular (at a true 90 degree angle) to the ground. Lastly, the tee of this invention incorporates features to ensure the stability of the golf tee upon impact with a club, thus minimizing the potential that the tee will either fracture along the spine or "pop" out of the ground and travel haphazardly.

Thus, as shown in the drawings of FIG. 1 and FIG. 2, the golf tee is indicated generally by reference numeral 10. The tee 10 is inserted into the turf on a golf course for supporting a golf ball (not shown) so that a golfer may drive the ball. The tee 10 itself includes a cylindrically shaped spine 14 having a pointed tip 24, for inserting the tee 10 into the ground, and a concave head 12, for supporting a golf ball (not shown) in an elevated position relative to the ground. These features are typically common with conventional tees. In the preferred embodiment, the golf tee 10 is molded with a rigid, yet somewhat flexible plastic resin. However, the tee 10 can be manufactured of other materials that are equally suited to this application, such as rubber, wood, metal, etc.

At the lower portion of the spine 14, but above the pointed tip 24, two ground anchoring prongs 22 extend vertically in an angled or "wedge-like" fashion outward from the spine 14. The ground anchoring prongs 22, upon being inserted into the ground, serve as the mechanism to stabilize the tee 10 upon impact with a club. The resistance provided by the top surface of the ground anchoring prongs 22 keeps the tee 10 from "popping" out of the ground and traveling haphazardly.

At a fixed position along the spine 14, a circular shaped base feature 20 extends outward from the spine 14. The base feature 20 serves as the means for limiting the insertion of the spine 14 into the ground, thereby ensuring the consistent tee height of the ball in relation to the ground each and every time the tee is used. Further, the base feature 20 is circular in nature. Thus, when the tee 10 is inserted into the ground, each and every point of the base feature 20 makes contact with the surface of the ground. This serves as the mechanism to align the spine 14, and therefore, the golf ball (not shown), in a position that is truly perpendicular to the ground. The base feature 20 is supported and joined to the spine 14 by an upper spine support radius 16 and a lower spine support radius 18. The upper spine support radius 16 and lower spine support radius 18 are designed to significantly strengthen the spine 14 and minimize the tendency of the tee 10 to fracture upon impact of a club head.

There are various possibilities with regard to the relative placement of the base feature 20 along the spine 14. FIG. 3 (perspective view) highlights a number of possibilities showing various positions of the base feature 20 in relation to the spine 14 and the head 12. Thus, a wide selection of tees 10 can be offered with base features manufactured at graduated lengths adapted to selectively accommodate the unique swing of each golfer, as well as the specific club selection required at each tee box. Also, the dimensions of the spine 14 can be varied as necessary based on the positioning of the base feature 20 in relation to the head 12, thus saving on material and controlling manufacturing expenses.

From the description above, a number of advantages of the invention become apparent:

a. The tee will stabilize itself upon impact with a club since the ground anchoring mechanism will provide resistance to keep the tee from "popping" out of the ground and traveling haphazardly. Ultimately, this feature makes the tee quicker and easier to retrieve from the tee box since it helps eliminate needless time spent looking for tees that have "taken flight" after a successful drive.

b. The non-adjustable base feature of this invention, upon insertion into the tee box, serves as a "stop" when it meets the surface of the ground. This allows a golfer to obtain a consistent tee height each and every, time the ball is teed up.

c. Tee shots will result in straighter, more accurate shots since the device is designed to fully align the tee, and therefore, the golf ball, in a position that is truly perpendicular to the ground.

d. Due to the incorporation of small radii above and below the base feature, the golf tee's strength is significantly increased.

e. The built in non-adjustable base feature facilitates placement of the golf ball at the desired tee height. This helps increase the speed of play by eliminating the time spent repositioning the adjustment mechanisms of multi-component tees or the height of the ball with conventional tees.

f. The "look" of the tee retains a strong resemblance to conventional golf tee devices that have come to be accepted by the majority of golfers. The simple form of the golf tee, coupled with its functionality, will appeal to golfers of all levels.

g. A wide selection of tee variations can be offered, each being color coded and having the base feature manufactured at a defined point along the spine of the tee. This will serve to accommodate the unique preferences of each golfer, as well as the specific club selection required at each tee box.

h. The base feature, while serving a functional purpose, also serves an aesthetic/ornamental purpose since it provides a very visible and broad circular surface area for personalization or advertising purposes.

i. Although the golf tee incorporates features designed to control factors that can adversely affect a golfer's game, it does so with a design that is simple in configuration, economical to manufacture, and convenient to carry and utilize on a golf course.

OPERATION OF THE INVENTION—FIGS. 1 to 3.

The manner for using the golf tee stand to drive a golf ball is relatively simple and is essentially identical to that of conventional tees in present use. Namely, one first grasps the tee 10 by the upper portion of the spine 14 and inserts the pointed tip 24 into the teeing ground. Pressure is applied to the tee head 12 to facilitate insertion into the ground. Oftentimes, a golf ball is placed on the tee head 12 before the pointed tip 24 is inserted into the ground. Pressure is then applied directly to the golf ball (not shown) to make insertion of the tee 10 easier. The base feature 20, upon making contact with the ground, serves both as a "stop" and an automatic alignment mechanism to locate the tee 10 and golf ball (not shown) in a position that is truly perpendicular to the ground. The ground anchoring prongs 22 work simply by inserting the tee 10 into the ground. The top surface of the ground anchoring prongs 22 provide fricitonal resistance to help stabilize the tee 10 upon impact from the club head. The function of the ground anchoring prongs 22 can be enhanced by twisting the tee one-half turn in a clockwise or counter clockwise direction after it has been inserted into the ground. This utilizes the soil above the ground anchoring prongs 22 as an additional source of resistance to further stabilize the tee 10.

To remove the tee 10 from the ground, the tee 10 is simply grasped by the upper portion of the spine 14 and lifted vertically. The tee 10 can be reused an unlimited number of times at the discretion of the golfer.

CONCLUSION, RAMIFICATIONS, AND SCOPE

Accordingly, the reader will see that the golf tee of the present invention provides a simple, economical, and convenient device that can help golfers of all skill levels to improve their mastery and enjoyment of the game of golf. While the description above contains many specificities, these should not be construed as limitations on the scope of the invention, but rather as the exemplification of one preferred embodiment thereof. Many other variations are possible. For example, the ground anchoring prongs can take various shapes, the prongs can be located at various points along the spine of the tee, the number of prongs can be modified, the upper and lower spine support radii can be resized or reshaped, the dimensions of the spine can be varied, etc. Accordingly, the scope of the invention should be determined not by the embodiment(s) illustrated, but by the appended claims and their legal equivalents.

We claim:

1. A golf tee device for supporting a golf ball above a ground surface comprising:

a cylindrically shaped spine having a pointed tip at a first end adapted to be inserted into the ground surface and a concave head at an opposite second end of said spine for supporting the golf ball, means for limiting the extent of insertion of said spine into the ground surface to thereby locate said concave head at a determined elevation above the ground surface and for aligning said spine in a fully perpendicular position relative to the ground surface, said limiting means comprising a base fixed securely and extending outward at a fixed position along said spine between the first and second ends, said limiting means being joined to said spine by a lower spine support radius and an upper spine support radius so as to strengthen said spine, and means for releasably anchoring said spine in the ground surface, said means comprising at least a pair of elongated ground anchoring members angling outward from the first end of said spine, said ground anchoring members solidly connected at all points of elongation to said spine, thereby strengthening said ground anchoring members and stabilizing said spine, head and base in the ground surface upon impact from a striking member, the means for releasably anchoring said spine cooperating with the limiting means to constrain the spine within the ground surface between the limiting means and the means for releasably anchoring without adversely affecting a golfer's ability to withdraw said spine from the ground surface.

* * * * *